US007269472B2

(12) United States Patent
Ammi

(10) Patent No.: US 7,269,472 B2
(45) Date of Patent: Sep. 11, 2007

(54) MANY-HEADED GRINDING MACHINE AND GRINDING METHOD USING MANY-HEADED GRINDING MACHINE

(75) Inventor: Sadatsune Ammi, Toyama (JP)

(73) Assignee: Nippei Toyama Corporation, Tokyo (JP)

( * ) Notice: Subject to any disclaimer, the term of this patent is extended or adjusted under 35 U.S.C. 154(b) by 58 days.

(21) Appl. No.: 11/144,691

(22) Filed: Jun. 6, 2005

(65) Prior Publication Data

US 2006/0014473 A1 Jan. 19, 2006

(30) Foreign Application Priority Data

Jun. 4, 2004 (JP) ..... P.2004-167564
May 27, 2005 (JP) ..... P.2005-156166

(51) Int. Cl.
*G06F 19/00* (2006.01)
*B23C 9/00* (2006.01)

(52) U.S. Cl. ..... 700/164; 409/196

(58) Field of Classification Search ..... 700/159, 700/160, 164, 172–176; 451/1, 5, 11, 21, 451/22, 64, 65; 409/131, 132, 145, 147–151, 409/154–156, 183–188, 192–196, 203
See application file for complete search history.

(56) References Cited

U.S. PATENT DOCUMENTS 4,254,588 A * 3/1981 Onoda et al. ..... 451/52
5,660,579 A * 8/1997 Nakayama et al. ..... 451/21
5,664,987 A * 9/1997 Renteln ..... 451/21
5,738,563 A * 4/1998 Shibata ..... 451/5
6,077,146 A * 6/2000 Sato et al. ..... 451/5
6,332,834 B1 * 12/2001 Nukui et al. ..... 451/57
6,511,364 B2 * 1/2003 Ido et al. ..... 451/10
6,682,403 B1 * 1/2004 Laycock ..... 451/49
6,852,015 B2 * 2/2005 Ito et al. ..... 451/49
7,037,173 B2 * 5/2006 Nonoyama et al. ..... 451/5
2002/0133268 A1 * 9/2002 Kato et al. ..... 700/193
2002/0155790 A1 * 10/2002 Ido et al. ..... 451/9
2003/0139120 A1 * 7/2003 Ito et al. ..... 451/49
2004/0248502 A1 * 12/2004 Junker ..... 451/11

FOREIGN PATENT DOCUMENTS

JP 2003-136379 A 5/2003

* cited by examiner

*Primary Examiner*—M. N. Von Buhr
(74) *Attorney, Agent, or Firm*—Sughrue Mion, PLLC

(57) ABSTRACT

A control device 40 controls the grinding processing at a processing portion of a work W so as to shift to the last precision grinding step from a rough grinding step through a middle grinding step and a finishing grinding step. When the grinding in each step is carried out, two processing portions are measured, and then, it is determined whether or not one or both measurement values attain to a predetermined value that has been determined in advance when each step is finished. When a processing time difference t is generated between the processing portions, by increasing or decreasing the feeding amount per unit time in a next step, the processing time difference is eliminated. Thereby, the finishing grinding step just before the last steps of the both processing portions are simultaneously finished.

9 Claims, 11 Drawing Sheets

MANY-HEADED GRINDING MACHINE AND GRINDING METHOD USING MANY-HEADED GRINDING MACHINE

BACKGROUND OF THE INVENTION

1. Field of the Invention

The present invention relates to a many-headed grinding machine such as a double-headed grinding machine to be adapted, for example, when grinding a pin of a clunk shaft for an engine and a grinding method using the many-headed grinding machine.

2. Description of the Related Art

According to the double-headed grinding machine, by simultaneously bring grinding wheels into contact with two processing places on a longitudinal work respectively while supporting the work between a pair of spindle stocks and rotating the work around its axis, outer circumferential faces of these processing places are ground and processed simultaneously. Then, grinding due to a plurality of grinding machines is carried out sequentially through a plurality of grinding steps such as rough grinding, middle grinding, and finishing grinding having different work rotation rate and different process feeding rate.

However, processing end timings in the above-described respective grinding steps may be varied due to a difference in flexure of the work and the sharpness of respective grinding wheels. Accordingly, in such a case, if the grinding processing of one grinding wheel is finished, the grinding processing is carried out only by other grinding wheel. Then, after the grinding processing due to the former grinding wheel is finished, the grinding is carried out only by one grinding wheel, so that a balance of grinding load added to the work becomes unstable and accuracy of processing is remarkably lowered.

In order to solve such a problem, in a patent document 1 (JP-A-2003-136379), the invention such that the last grinding processing of the work due to a pair of grinding wheels are carried out simultaneously has been proposed. According to the invention disclosed in this patent document 1, upon grinding processing of a plurality of places on the longitudinal work by using a plurality of grinding wheels, the outer circumferential measurement if each processing place of the work is measured. Then, on the basis of this measurement, a plurality of grinding wheels is controlled to be driven. In other words, as shown in FIG. 12, when a measurement value (the outer circumferential method of the work) at the processing portion of the former grinding processing is made into a predetermined value d, the cutting of this former processing portion is stopped. Then, till the measurement value at the processing portion of the following grinding processing is made into the predetermined value d, the cutting of the former processing portion is awaited, and when the measurement values of the former and following processing portions coincide with each other, the cutting of the both are restarted at the same time to start the last precision grinding step.

[Patent document 1] JP-A-2003-136379

According to the invention in the above-described patent document 1, by starting the last grinding steps simultaneously, the processing precision can be improved, however, even when one grinding wheel stops the feeding since it awaits other grinding wheel, the work contacts the grinding wheel via a grinding liquid and the cutting of the work may proceed with the work pressed against the grinding wheel by its elastic recovery or the like. Therefore, even if the last grinding step is carried out, necessary precision may not be acquired at one processing portion and imbalance is caused between the processing portions of the work. In order to prevent the cutting from proceeding at the side where the processing feeding stops, it may be possible that the grinding wheel is separated from the work, however, in such a case, it is feared that the imbalance becomes larger due to bringing the grinding wheel into contact with the work again.

SUMMARY OF THE INVENTION

An object of the present invention is to provide a many-headed grinding machine callable of attaining to a high precision without causing imbalance when finishing the work between the processing portions and a grinding method.

In order to attain the above-described object, according to aspect 1, there is provided with a many-headed grinding machine for simultaneously grinding and processing a plurality of places of a work supported by work supporting section with a plurality of grinding wheels to be independently process-fed, including: measuring section for measuring an outer diameter measurement of each grinding place in mid-course of grinding; and adjusting section, when a difference of the outer diameter measurement is generated between the grinding places by measurement due to the measuring section, which adjusts feeding amount per unit time of at least one grinding wheel so as to eliminate the difference.

According to aspect 2, there is provided with the many-headed grinding machine according to aspect 1, wherein the adjusting section adjusts the feeding amount by replacing the difference of the outer diameter with a difference of the processing time that has been required till the outer diameter measurement attains to a predetermined value.

According to aspect 3, there is provided with the many-headed grinding machine according to aspect 2, further including: storage section for storing each processing time that has been required till the outer diameter measurement attains to a predetermined value when the measurement section measures the predetermined value of the outer diameter measurement at each grinding place, wherein the adjusting section adjusts the feeding amount so that the difference of the processing time stored in the storage section is eliminated in the grinding step till a next predetermined value.

According to aspect 4, there is provided with the many-headed grinding machine according to aspect 1, wherein the work supporting section rotates the work by chucking the opposite ends of a longitudinal work.

According to aspect 5, there is provided with a grinding method using a many-headed grinding machine for simultaneously grinding and processing a plurality of places of a work with a plurality of grinding wheels to be independently process-fed, including the steps of: measuring an outer diameter measurement of each grinding place in mid-course of grinding; and adjusting feeding amount per unit time of at least one grinding wheel so as to eliminate the difference, when a difference of the outer diameter measurement is generated between the grinding places as a result of measurement.

According to aspect 6, there is provided with the grinding method using a many-headed grinding machine according to aspect 5, wherein the grinding processing includes a plurality of grinding steps from a rough grinding to the last precision grinding, and a difference of an outer diameter difference generated in the former steps till the grinding step shifts to the last precision grinding step is eliminated in the following steps.

According to aspect 7, there is provided with the grinding method using a many-headed grinding machine according to aspect 5, wherein the difference of the outer diameter is replaced with a difference of the processing time that has been required till the outer diameter measurement attains to a predetermined value at each grinding place.

According to aspect 8, there is provided with the grinding method using a many-headed grinding machine according to aspect 7, further including the steps of: storing each processing time that has been required till the outer diameter measurement attains to a predetermined value, when the predetermined value of the outer diameter measurement is measured at each grinding place; and adjusting the feeding amount so that the difference of the processing time stored in the storage section is eliminated in the grinding step till a next predetermined value.

According to aspect 9, there is provided with the grinding method using a many-headed grinding machine according to aspect 5, the work is a clunk shaft, and the grinding wheel grinds the clunk pin of the clunk shaft.

Accordingly, in the present invention, when there is a difference of the outer diameter measurement between the grinding portions upon the simultaneous grinding of the work at plural places due to a plurality of grinding wheels, feeding amount per unit time of one grinding wheel is adjusted so as to eliminate this difference of the outer diameter measurement and this leads to finish of the grinding processing at the same time. Therefore, the waiting time of one grinding wheel is gradually reduced and this makes it possible to acquire the high precision processing without causing imbalance on finishing between the grinding portions of the work. In addition, since the difference generated in the former step till the processing has shifted to the last grinding step is eliminated in the following step, the finishing grinding steps just before the last step are finished at the same time and the both grinding wheels can start the last precision grinding processing without making one of the grinding wheels wait. As a result, the high precision processing without imbalance can be attained and the processing efficiency can be improved.

DETAILED DESCRIPTION OF THE PREFERRED EMBODIMENTS

First Embodiment

The first embodiment such that the present invention is embodied in the double-headed grinding machine will be described below with reference to FIGS. 1 to 7.

Figure 1:
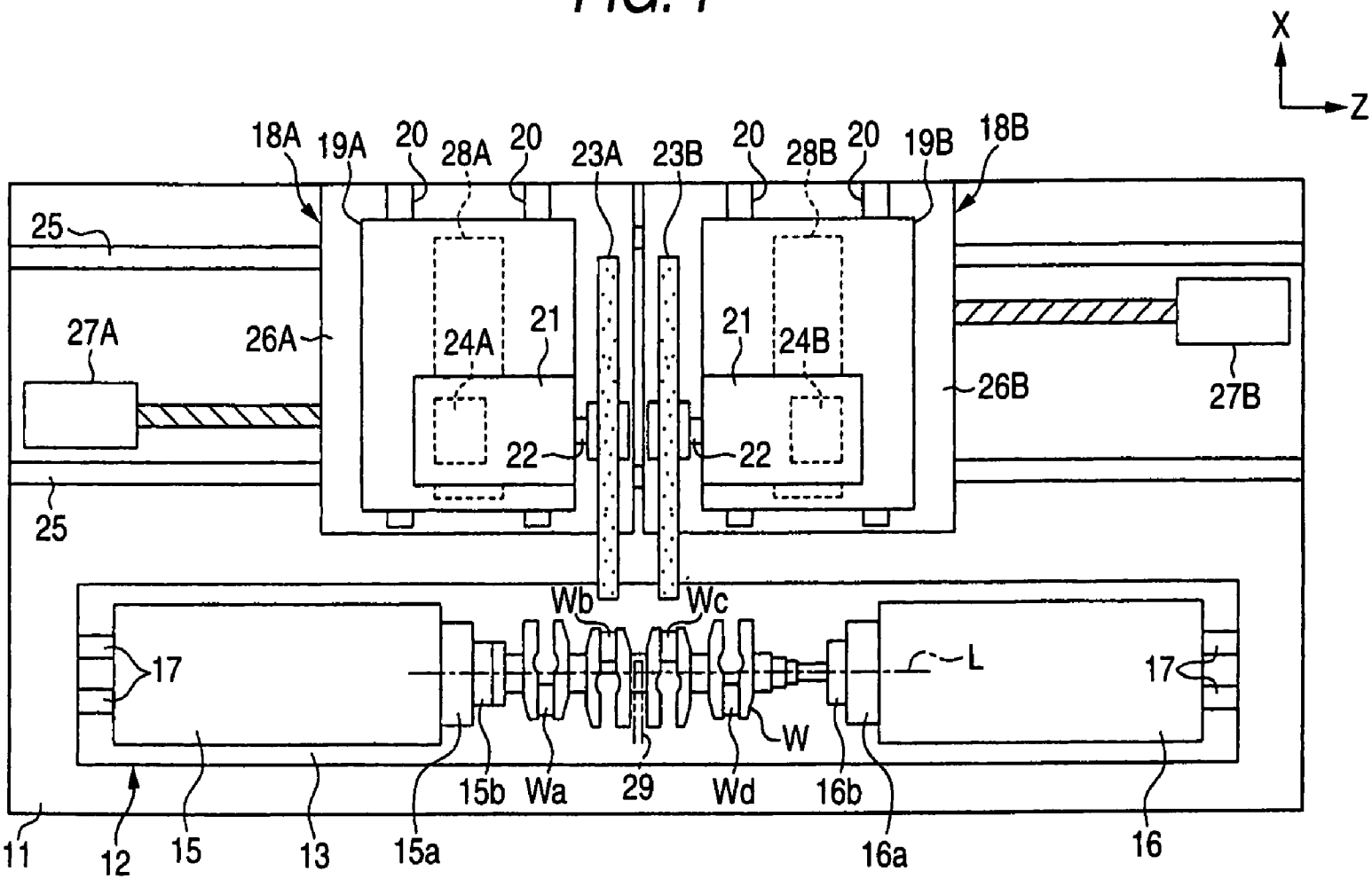
FIG. 1 is a plan view showing a double-headed grinding machine according to a first embodiment.

As shown in FIG. 1, in this double-headed grinding machine, a work supporting device 12 is placed on a mount base 11. In other words, on the upper face of the mount base 11, a supporting table 13 is fixed on the upper face of the supporting table 13, a pair of spindle stocks 15 and 16 rotatably supporting the spindles 15*a* and 16*a* are supported to be movably adjustable in the axial direction in parallel with the Z axis via guide rails 17, and at the opposed ends of these, chucks 15*b* and 16*b* are provided as work supporting section for supporting a work W formed by a clunk shaft at its opposite ends.

On the mount base 11, a pair of grinding devices 18A and 18B is arranged to be supported movably in the Z axis direction via a pair of guide rails 25 respectively so as to correspond to the work supporting device 12. In addition, in each of the grinding devices 18A and 18B, grinding machine tables 19A and 19B are supported on the upper face of the base mount 11 via each pair of guide rails 20 to be movable in the X axis (the feeding direction and its reverse direction), and on the upper surface of these grinding machine tables 19A and 19B, a processing head 21 is arranged. A rotational axis 22 is rotatably supported by each processing head 21 and at their opposed end portions, first and second grinding wheels 23A and 23B are attached.

In each processing head 21, first and second motors for rotating grinding a stone 24A and 24B are incorporated, which are formed by built-in motors as a grind driving unit, and by these motors 24A and 24B, respective grinding wheels 23A and 23B are rotatably ground. Between the mount base 11 and respective grinding stone tables 19A and 19B, the first and second motors for rotating a grinding stone 24A and 24B are arranged, which are composed of linear motors, and by these motors 28A and 28B, respective grinding stone tables 19A and 19B are moved in a X axis direction, respectively. In addition, respective grinding devices 18A and 18B are moved respectively in the Z axis direction by traverse motors 27A and 27B.

Then, according to this embodiment, processing portions Wa to Wd as the grinding portion of the work W are pins of the clunk shaft. In the case of grinding and processing these processing portions Wa to Wd, the spindle stocks 15 and 16 are movably adjusted in the axis direction by motors for traverse the spindle stocks represented by reference marks $M_1$ and $M_2$ of FIG. 3 (not illustrated) so that the work W is appropriately fit between a pair of spindles 15*a* and 16*a*. Then, in association with the processing portions Wb (Wa)

and Wc (Wd) of two places on this work W, the first and second grinding wheels 23A and 23B are arranged by the traverse motors 27A and 27B. Under this condition, the work W is rotated around an axis line L, namely, around a journal by the spindle motors represented by reference marks 15*c* and 16*c* in FIG. 3 (not illustrated) that are incorporated in the spindle stocks 15 and 16 respectively.

Therewith, the first and second grinding wheels 23A and 23B are fed and moved by the motors for feeding a grinding stone 28A and 28B toward the work W in the X axis direction on the basis of the profile amount and a predetermined cutting amount in synchronization with the rotation of the spindles 15*a* and 16*a* while being rotated by the first and second motors for rotating a grinding stone 24A and 24B at a predetermined rotation rate. Due to this feeding and moving, respective grinding wheels 23A and 23B contact the two processing portions Wb (Wa) and Wc (Wd) on the work W and the outer circumferential faces of these processing portions Wb (Wa) and Wc (Wd) are simultaneously ground.

Figure 5:
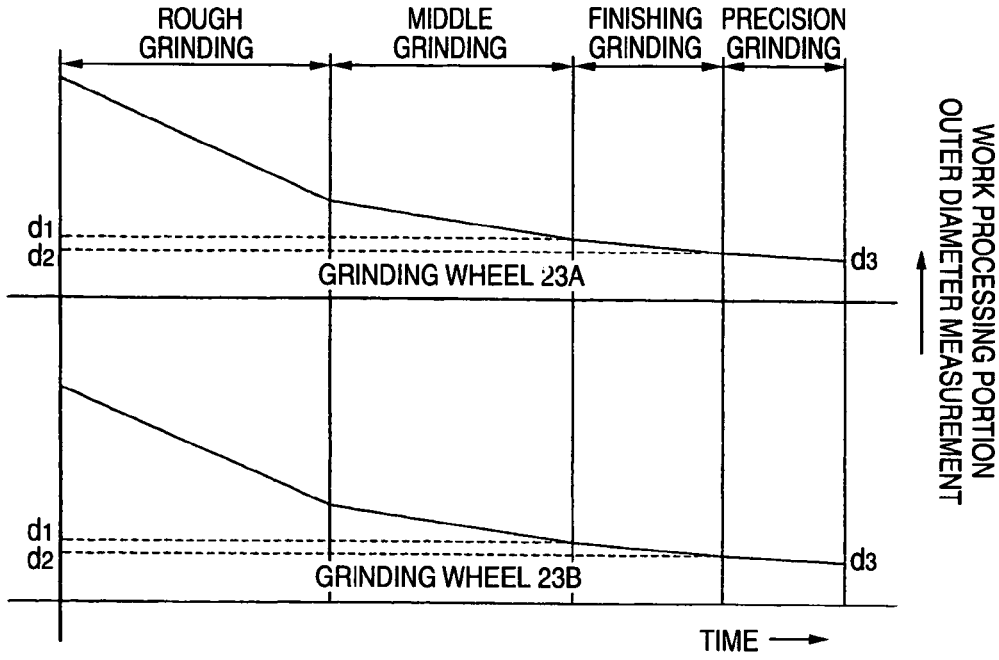
FIG. 5 is a diagram explaining the grinding processing operation of the double-headed grinding machine shown in FIG. 1.

As shown in FIG. 1, on grinding processing of two processing portions Wb (Wa) and Wc (Wd) on the work W, according to this embodiment, on the middle rough grinding and the finishing grinding shown in FIG. 5, a work rest 29 abuts against the outer circumferential faces of one or two journal portions located between the both processing portions Wb (Wa) and Wc (Wd) on the work W. Due to this abutting, the work W is supported from the side opposed to the grinding wheels 23A and 23B.

Figure 2:
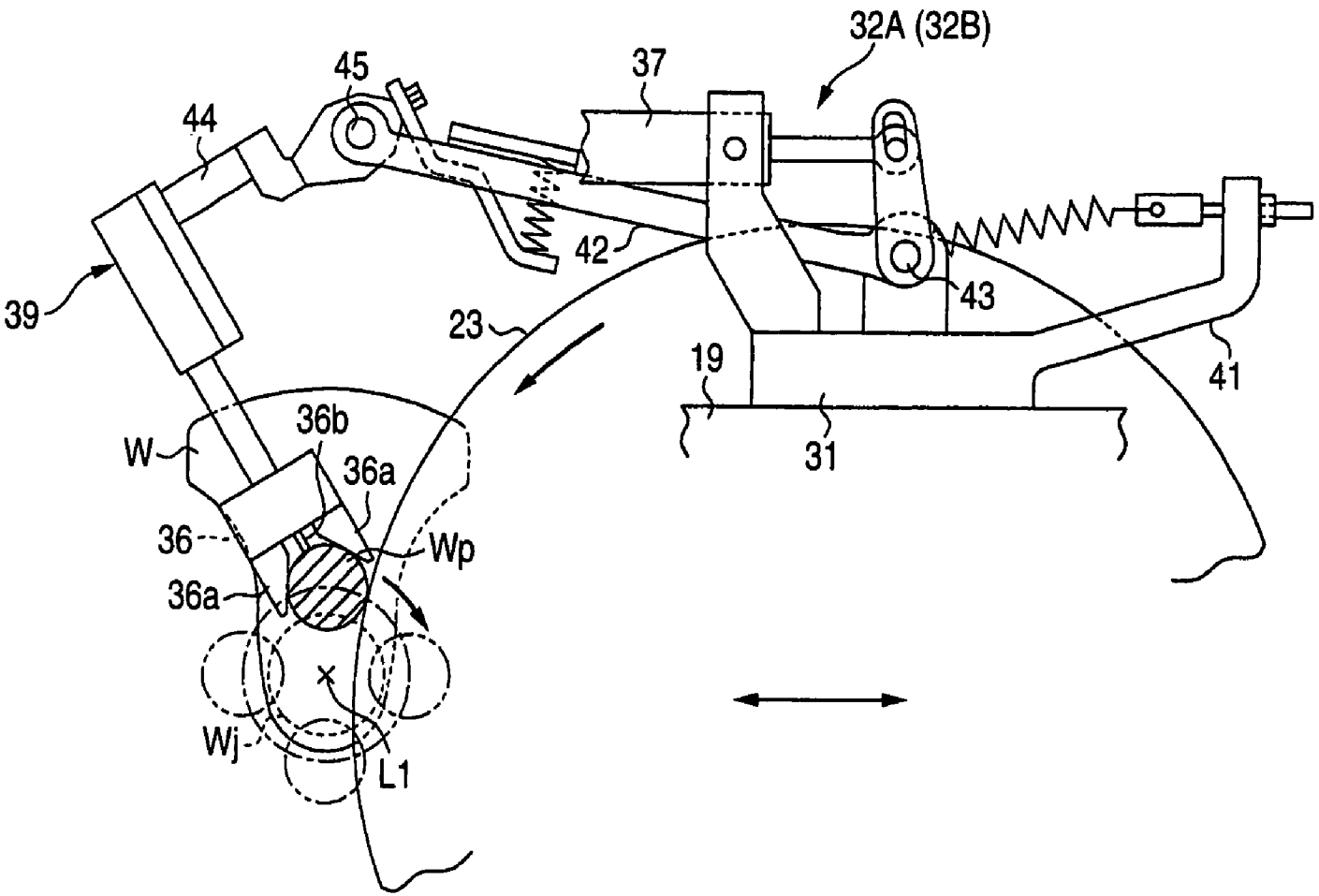
FIG. 2 is a substantial sectional view showing an enlarged gage device of the double-headed grinding machine shown in FIG. 1.

As shown in FIG. 2, on the above-described respective grinding stone tables 19A and 19B, pin diameter measuring devices 32A and 32B are arranged as measuring section. Then, on grinding processing of the respective processing portions Wb (Wa) and Wc (Wd) on the work W, the outer circumferential measurements of these respective processing portions Wb (Wa) and Wc (Wd) are measured by a pin diameter measurement device 39.

In other words, on the grinding stone tables 19A and 19B, a bracket 41 is attached, and a support arm 42 is rotatably supported by the bracket 41 via a support shaft 43. At the front end of the support arm 42, an attachment member 44 is rotatably supported via a support shaft 45, and the lower part of the front end, a gage 36 is attached. On this gage 36, a pair of a contact element 36*a* and a measurement element 36*b* is provided, which can contact the outer circumferential face of a clunk pin Wp corresponding to the processing portions Wa to Wd.

On the above-described bracket 41, a cylinder for a gage 37 is arranged, and its piston rod is operatively connected to a support arm 42. Then, by operating this cylinder 37 so as to make frequent appearance, the support arm 42 is rotated around the support axis 43 and the gage 36 is moved and arranged at the upper escape position and at the lower measurement position. In addition, with the gage 36 moved and arranged at the measurement position, the contact element 36*a* and the measurement element 36*b* contact the clunk pin Wp from the opposite side of a rotating grinding stone 23 during the grinding processing and the outer diameter measurement of the clunk pin Wp is measured via the measurement element 36*b*.

Moreover, on measurement of the pin diameter by this gage 36, in association with orbiting of the clunk pin Wp around an axial line L1 of a journal Wj, an attachment member 44 is rotated around the support shaft 45. Due to this rotation, the measurement position of the gage 36 is always maintained at a substantially regular position against the clunk pin Wp.

Figure 3:
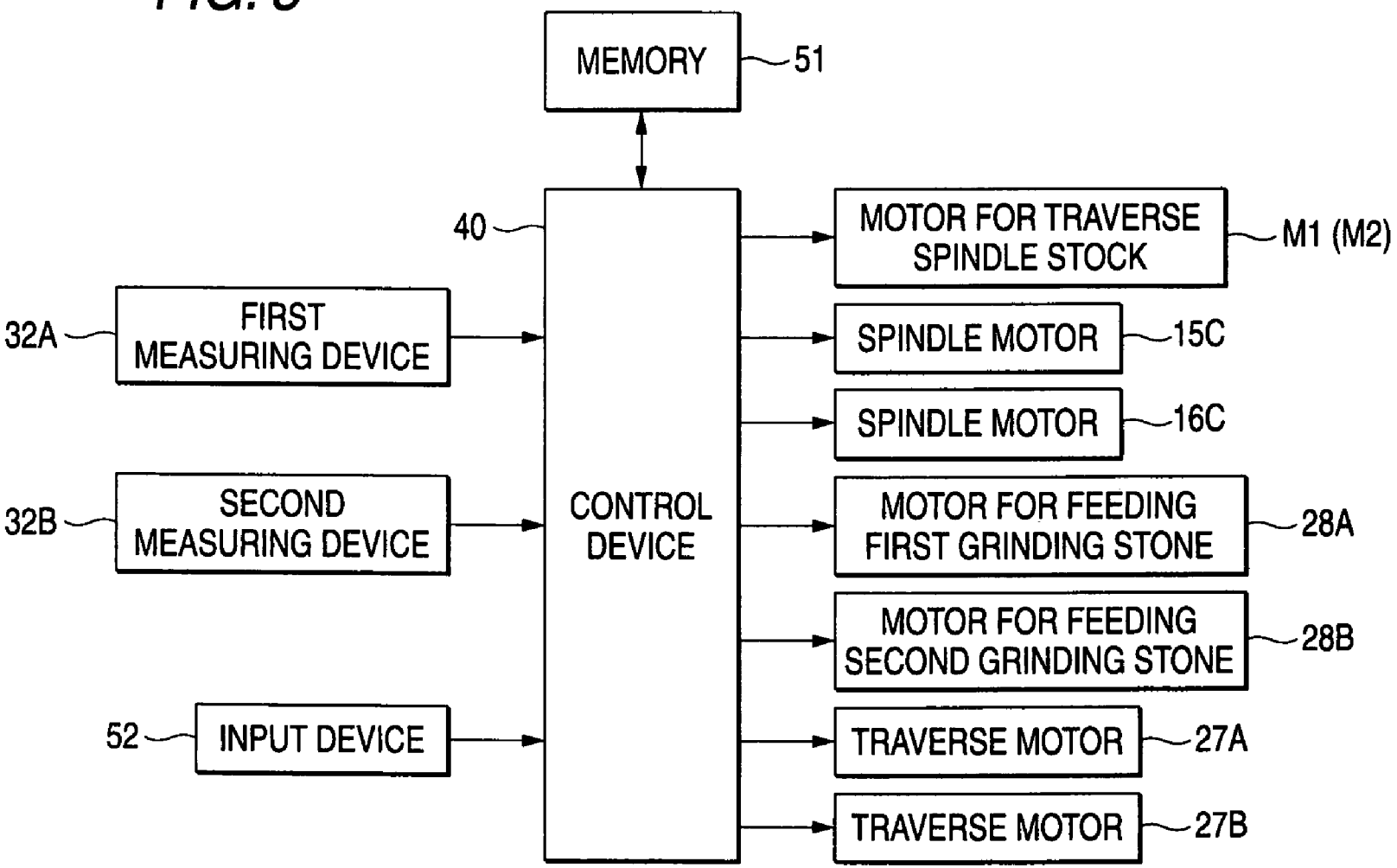
FIG. 3 is a block diagram showing a circuit structure of the double-headed grinding machine.

Next, the structure of a control device 40 of the double-headed grinding machine that has been configured as described above will be described below. As shown in FIG. 3, a control device 40 as control section and adjusting section is connected to a memory 51 as storage section for storing the various data and a program or the like necessary to control the operation of the grinding machine and an input device 52 such as a key board to be used for inputting the various data or the like. In addition, a measurement signal of the outer measurement in the processing portions Wa to Wd of the work W is inputted in the control device 40 from the first and second measuring devices 32A and 32B. Further, a position control signal is outputted to the motors for moving the spindle stocks $M_1$ and $M_2$ and the traverse motors 27A and 27B of the grinding devices 18A and 19A from the control device 40, and on the processing, a driving signal and a control signal are outputted to the motors 28A and 28B for feeding the grinding stone of the both of the grinding devices 18A and 18B and the spindle motors 15*c* and 16*c*.

Then, the control device 40 may independently control the operations of respective motors 15*c*, 16*c*, 28A, and 28B on the basis of the measurement information from the both measuring devices 32A and 32B during grinding due to the processing program stored in the memory 15 to control 17 the rotation rate and the processing feeding rate of the spindles 15*a* and 16*a*, namely, the feeding amount or the like of the grinding stone tables 19A and 19B. Due to control of them, the grinding processing at the processing portions Wa to Wd on the work W by respective grinding wheels 23A and 23B are carried out while switching the middle rough grinding step, the finishing grinding step, and the precision grinding step as the last grinding step in the order every time their outer circumferential diameters attain to predetermined values.

In this case, the control device 40 may control the cutting rate into the appropriate one. The data of this cutting rate is stored in the memory 51 as the data of the standard cutting rate.

In addition, the control device 40 may carry out the compensation of a formation error (refer to FIGS. 10A and 10B) generated in the synchronization processing operations of the spindles 15*a* and 16*a* and the grinding machine tables 19A and 19B in the respective grinding steps so as to eliminate the specific grinding property held by the both grinding devices 18A and 18B and a grinding error on a profile face caused by a load interference or the like on the simultaneous processing. For example, when an error in a plus direction is generated on the grinding processing faces of the processing portions Wa to Wd, the feeding amounts of the grinding stone tables 19A and 19B are adjusted by adding the error compensation amount e (θ).

Moreover, on this grinding processing of the work W, due to the elastic deformation and the flexure of the work W or the difference in the sharpness between respective grinding wheels 23A and 23B or the like, a difference in the grinding amount may be generated at respective processing portions Wa to Wd of the work W. In such a case, the control device 40 may execute the control program shown in a flow chart of FIG. 4 to be described later that is stored in the memory 51 to eliminate the difference in the outer diameter measurements between respective processing portions Wa to Wd and then, the processing is carried out so as to make the respective processing portions Wa to Wd into predetermined outer diameter measurements.

Next, the operation of the double-headed grinding machine that has been configured as described above will be described below.

In the meantime, in this double-headed grinding machine, in the case of grinding and processing the processing portions Wa to Wd of the work W, namely, the clunk pin of the clunk shaft, the work W is fit between the chucks 15*b* and 16*b* of a pair of spindles 15*a* and 16*a*. In this condition, due to moving of the grinding devices 18A and 18B, the first and second grinding wheels 23A and 23B are arranged corresponding to the two processing portions Wb (Wa) and Wc (Wd) on the work W, and the work W may pivot around the axial line L, namely, the pint Wp as the processing portions Wb (Wa) and Wc (Wd) may pivot separating from the rotational center of the journal Wj by a predetermined amount.

Figure 10A:
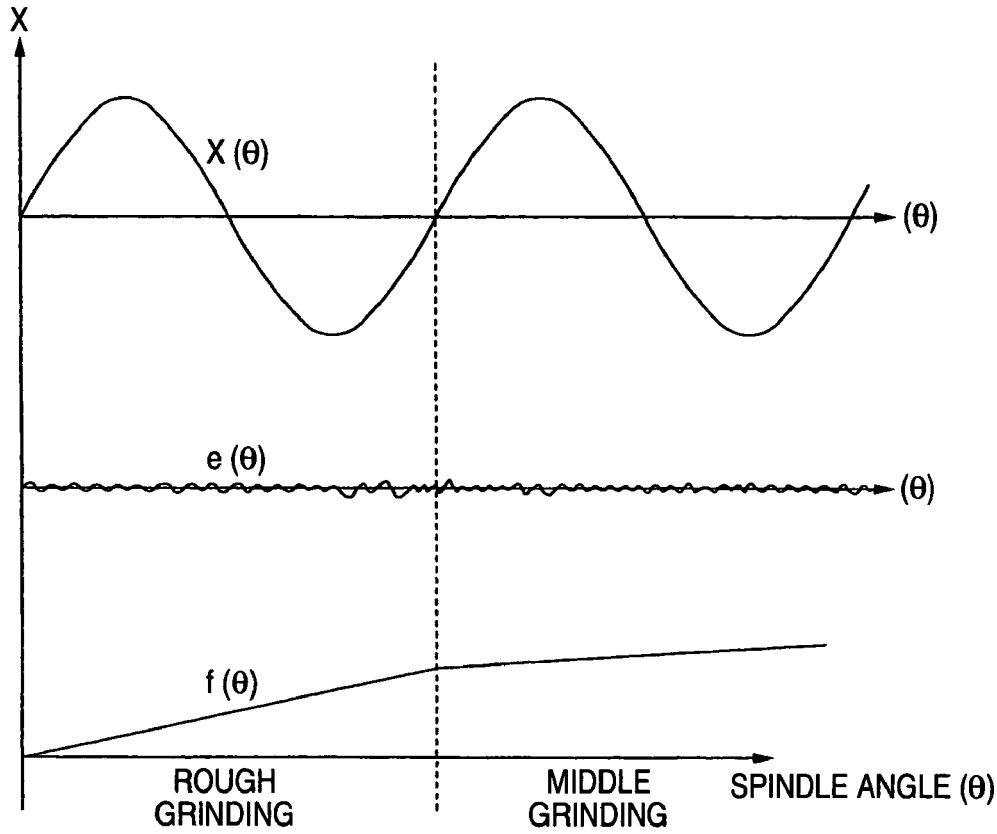
FIGS. 10A and 10B are graphs showing a relation between an X axis feeding and moving amount X (θ), a profile amount x (θ), an error compensation amount e (θ), and a cutting amount f (θ).
Figure 10B:
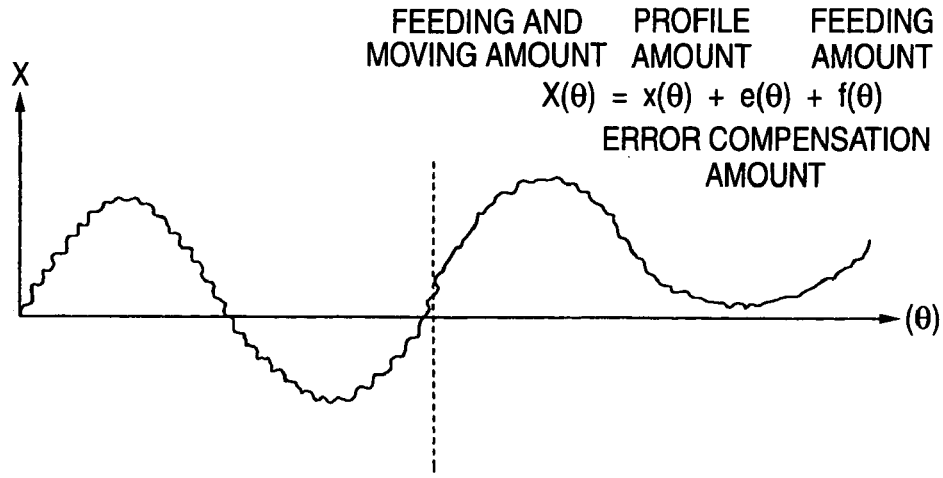

Simultaneously, the both grinding wheels 23A and 23B move in the X axis direction on the basis of the position control data of the X axis feeding and moving amount X (θ) in which the profile amount x (θ) in synchronization with the rotation of the spindles 15*a* and 16*a*, the error compensation amount e (θ), and the feeding amount t (θ) are superimposed as shown in FIGS. 10A and 10B by the motors for moving a grinding stone 28A and 28B as they are rotated by the first and second motors for rotating grinding a stone 24A and 24B at a predetermined rotation rate. Due to this movement, as shown in FIG. 5, the outer circumferential faces of the two processing portions Wb (Wa) and Wc (Wd) on the work W are ground at the same time.

At first, when the cylindrical face is formed by the rough grinding, the outer diameter measurements of respective processing portions Wb (Wa) and Wc (Wd) are always measured by the measuring devices 32A and 32B. Then, when the measured measurement attains to a predetermined value d1 of the middle grinding completion measurement that has been set in advance, the cuttings of respective grinding wheels 23A and 23B are changed from the middle rough grinding into the finishing grinding, and then, the processing to respective processing portions Wb (Wa) and Wc (Wd) are switched from the middle rough grinding into the finishing grinding.

Continuously, also on this finishing grinding processing, the outer diameter measurements of respective processing portions Wb (Wa) and Wc (Wd) are always measured by the measuring devices 32A and 32B. Then, if the measured measurement of the former processing portion of the grinding processing attains to a predetermined value d2 of the finishing grinding completion measurement that has been set in advance, the feeding of the both grinding wheels 23A and 23B are changed from the finishing grinding into the precision grinding, and as shown in FIG. 5, the precision grinding processing to respective processing portions Wb (Wa) and Wc (Wd) may start at the same time and it may finish at a predetermined value d3.

Figure 6:
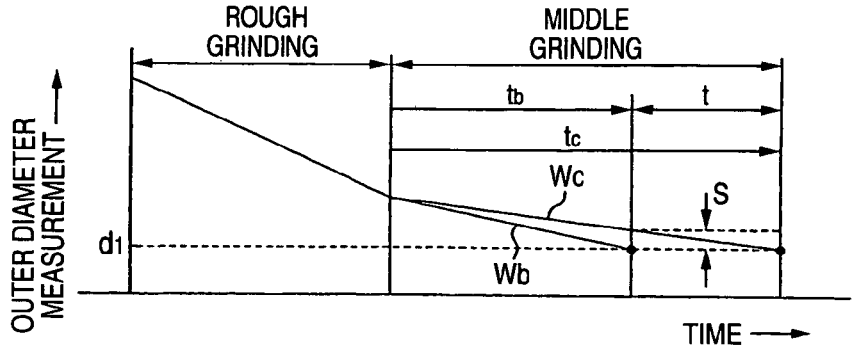
FIG. 6 is a diagram explaining the measurement difference eliminating operation of the double-headed grinding machine shown in FIG. 1.
Figure 7:
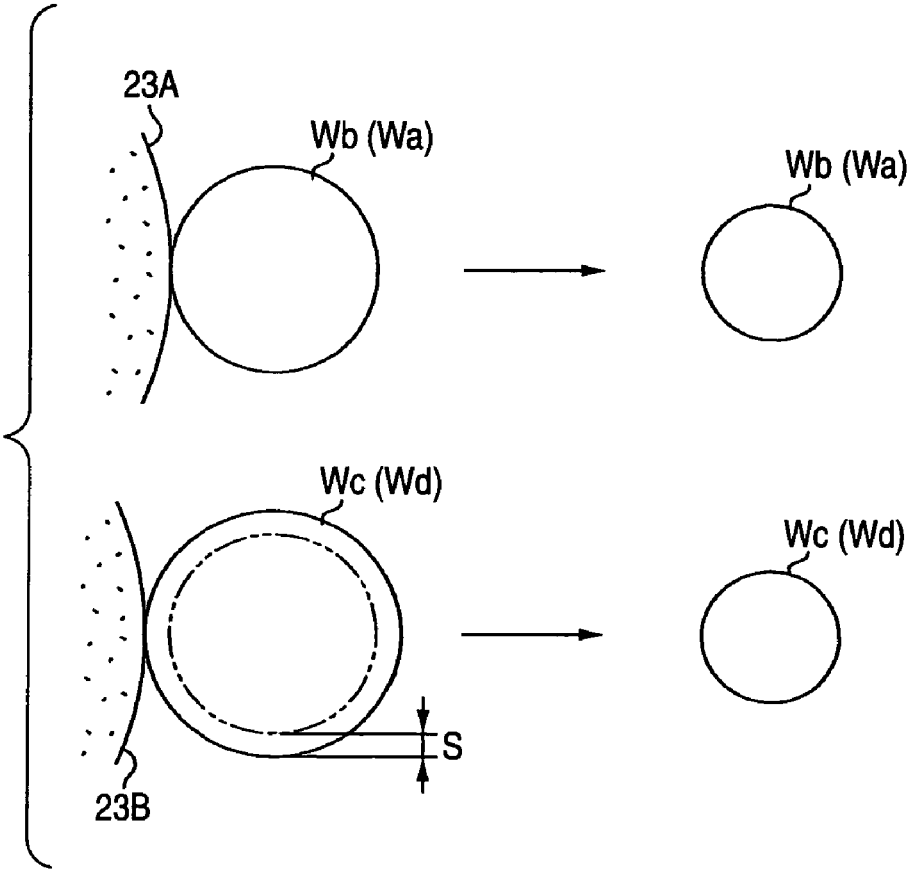
FIG. 7 is a schematic view explaining the elimination of the measurement difference.

In this case, because of the flexure of the work W and the difference in the sharpness between the grinding wheels 23A and 23B, as shown in FIG. 7, if a difference s of the grinding amount, namely, a difference of the outer diameter is generated between the respective processing portions Wb (Wa) and Wc (Wd) due to the grinding wheels 23A and 23B in respective grinding processing steps when one processing portion attains to, for example, a predetermined outer diameter measurement d1, as shown in FIG. 6, this difference s of the grinding amount is placed with a difference t=tc−tb between respective processing times tb and tc that are required till the outer diameter measurement between respective processing portions Wb and Wc attain to the predetermined value d1. Then, in order to eliminate the processing time difference t, the control device 40 may carry out the following processing for adjusting the feeding amount per unit time shown in FIG. 4.

Figure 4:
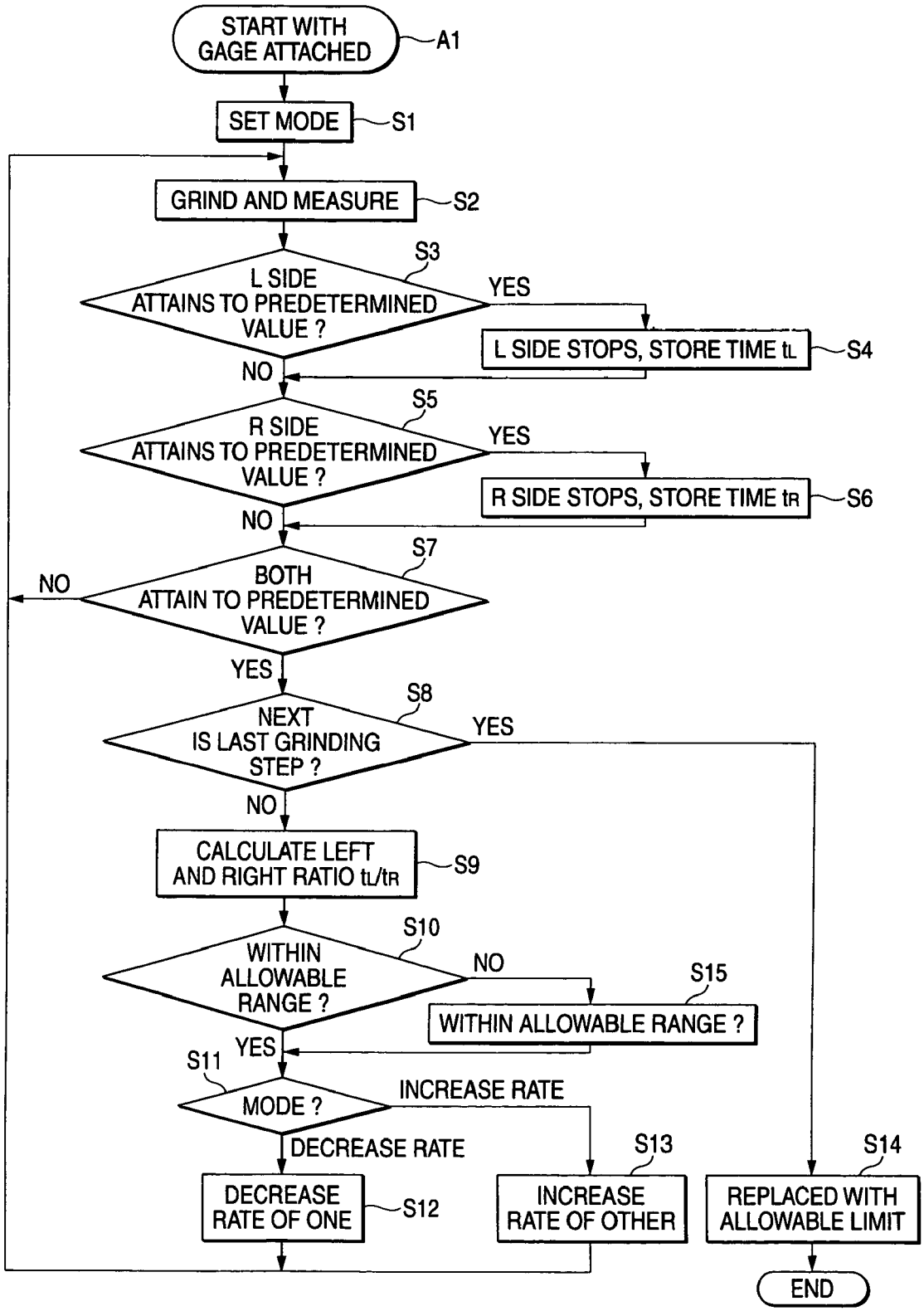
FIG. 4 is a flow chart explaining the grinding processing operation of the double-headed grinding machine shown in FIG. 1.

The flow chart shown in FIG. 4 may indicate the processing in each grinding step of the middle rough grinding, the finishing grinding, and the precision grinding, in which the outer diameter measurements of the processing portions Wa to Wd during grinding are measured. The gage 36 is set at the processing portions Wa to Wd and it starts to move. In step S1 (hereinafter, "the step S" is merely referred to as "S"), the input device 52 is operated by an operator to set a mode of the elimination in advance whether the processing time difference t between the processing portions Wa to Wd is eliminated by increasing the feeding amount per unit time, namely, increasing the feeding rate of the grinding wheels 23A and 23B or by decreasing the feeding amount per unit time, namely, decreasing the feeding rate thereof. In other words, if the processing time difference t is generated, this processing time difference t is eliminated by increasing or decreasing the cutting rate of the grinding wheel 23A or 23B than the cutting rate of other grinding wheel 23B or 23A, and then, in order to make respective processing portions Wa to Wd to attain to a predetermined outer diameter measurement during the same processing time, the rate increase mode or the rate decrease mode is set.

In S2, the grinding and the measurement are carried out at the above-described respective two processing portions, for example, Wb and Wc. Then, in S3 and S5, it is determined that the measurement result of any one of the processing portion Wb or Wc, namely, the L (left) side or the R (right) side attains to predetermined values d1, d2, . . . at the end of each step that have been decided in advance or not. If it attains to the predetermined value, in S4 and S5, the processing time tb or tc till it attains to the predetermined value in the current step from starting of the processing is counted and stored. Further, stopping feeding of the grinding wheel 23A or 23B that attains to the predetermined value in advance, the grinding processing may await till any other grinding wheel attains to the predetermined value (t in FIG. 8).

Next, if it is determined whether the both processing portions Wb and Wc attains to the predetermined value or not, in S8, it is determined that whether the next step is the last grinding step or not, namely, this grinding step that has finished now is the step just before the last grinding step or not. If this grinding step is not the step just before the last grinding step, in S9, its time ratio $t_L/t_R$ is calculated, and in S10, it is determined that this ratio is within the allowable range that has been set in advance or not and the allowance check is carried out in order to prevent the ratio from remarkably deviating from the grinding and processing, condition. In this case, if it is within the allowable range, in S11, it is determined at which mode of increase of the rate or decrease of the rate the mode set in the S1 is set, and on the basis of its determination result, in S12 or S13, the cutting rate in the next step is set to be increased or decreased ant the processing may return to the S2. Accordingly, as being obvious from FIG. 8, in the next step, the processing time difference t, namely, a measurement difference s is eliminated, and further, the grinding is carried out in such a manner that the feeding rate of one of the grinding wheels 23A or 23B is adjusted to be increased or decreased so that the grinding processing at respective processing portions Wb and Wc may finish at the same time when they are made into the predetermined outer measurement at the same time.

In his case, adjustment of the cutting rate per unit time may be carried out as follows. In other words, assuming that times till the grinding wheels 23A and 23B attain to the predetermined value as tb and tc, respectively and the feeding rates in the next step of the grinding wheels 23A and 23B that have been set in advance as vb and vc, respectively, the feeding rates vb' and vc' of the grinding wheels 23A and 23B in the next step are adjusted so that the followings are satisfied, namely, tb>tc, in the case of increase of the rate, vb'=vb (tb/tc), vc'=vc; tb<tc, in the case of increase of the rate, vc'=vc (tc/tb), vb'=vb; tb>tc, in the case of decrease of the rate, vc'=vc (tc/tb), vb'=vb; and tb<tc, in the case of decrease of the rate, vb'=vb (tb/tc), vc'=vc. The feeding rates vd' and vc' after the adjustment are placed within the range satisfying grinding conditions if they are placed within the allowable range on the allowable check in the S10.

Figure 8:
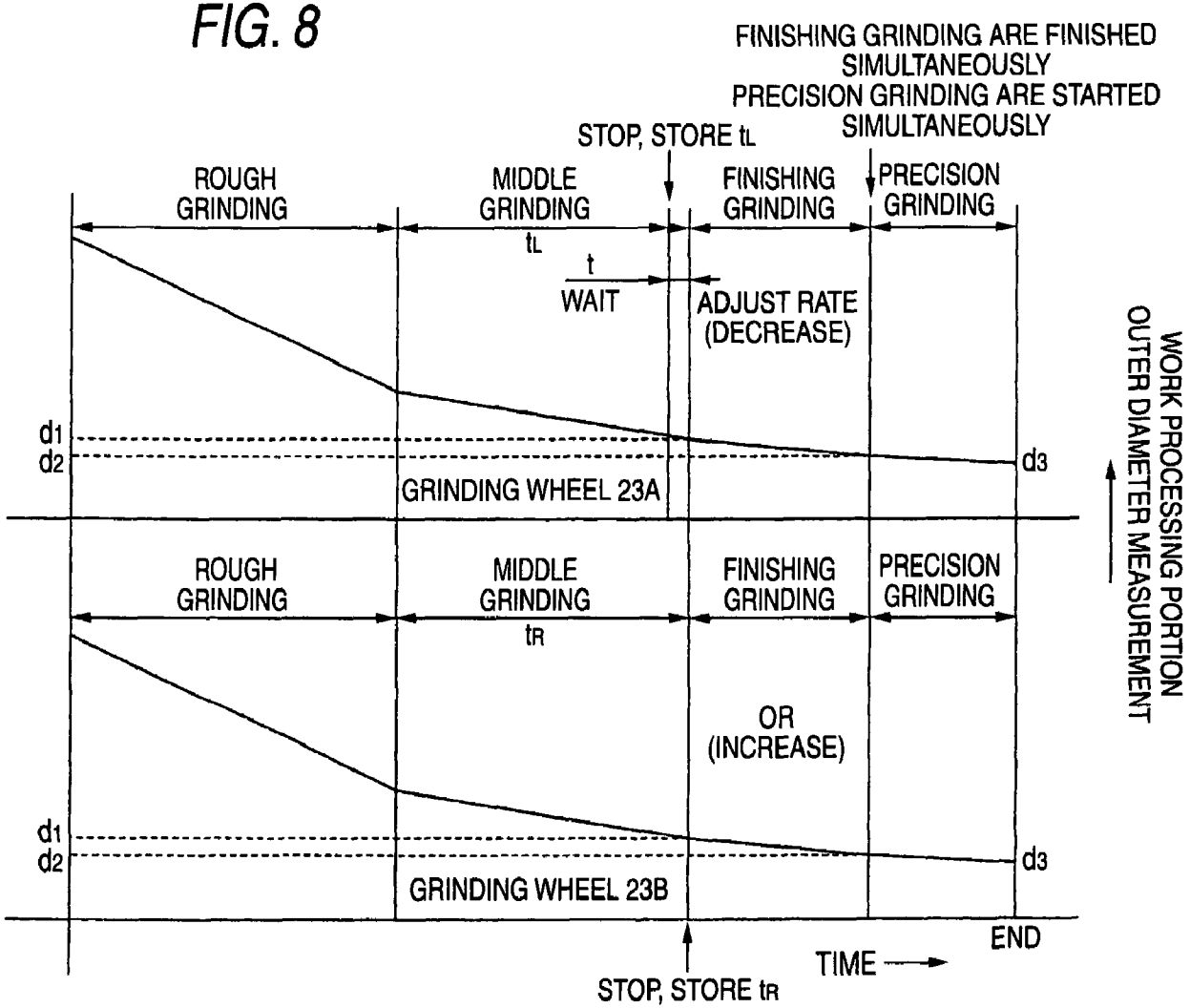
FIG. 8 is a diagram explaining the grinding processing operation of the double-headed grinding machine on the basis of the flow chart shown in FIG. 4.

Therefore, for example, as shown in FIG. 6 and FIG. 8, in the case that the processing time difference t is generated between one processing portion Wb (Wa) and other processing portion Wc (Wd) in the middle rough grinding, the feeding rate of any one of the grinding wheels 23A and 23B, of which grinding is late, is increased or the feeding rate of other one of the grinding wheels 23A and 23B, of which grinding is fast, is decreased depending on the setting mode so that the processing time difference t is eliminated when the processing in the next step is finished.

Thus, when the processing time difference t is generated between the processing portion Wb (Wa) and Wc (Wd), in order to eliminate this processing time difference t, the feeding rate of one of the grinding wheels 23A and 23B is increased or decreased in the next step to terminate the grinding processing thereof at the same time. Therefore, without generation of the imbalance between the processing portion Wb (Wa) and Wc (Wd) on the work W, the high precision processing can be acquired.

Then, if the next grinding step is the last one in S8, without the calculation of the time ratio and the adjustment of the cutting rate in S9 to S13, the precision grinding step of the last step are started at the same time in S14. In other words, without waiting time, the both grinding wheels can start the last steps simultaneously and can end them simultaneously.

In S10, if the right and left ratio is not placed within the allowable range, in S15, tb/tc or tc/tb in the above-described formulas is replaced with the allowable limit value so as to carry out the processing in S31, S12, and S13. Thereby, it is possible to maintain the reasonable grinding processing satisfying the grinding and processing conditions.

Figure 9:
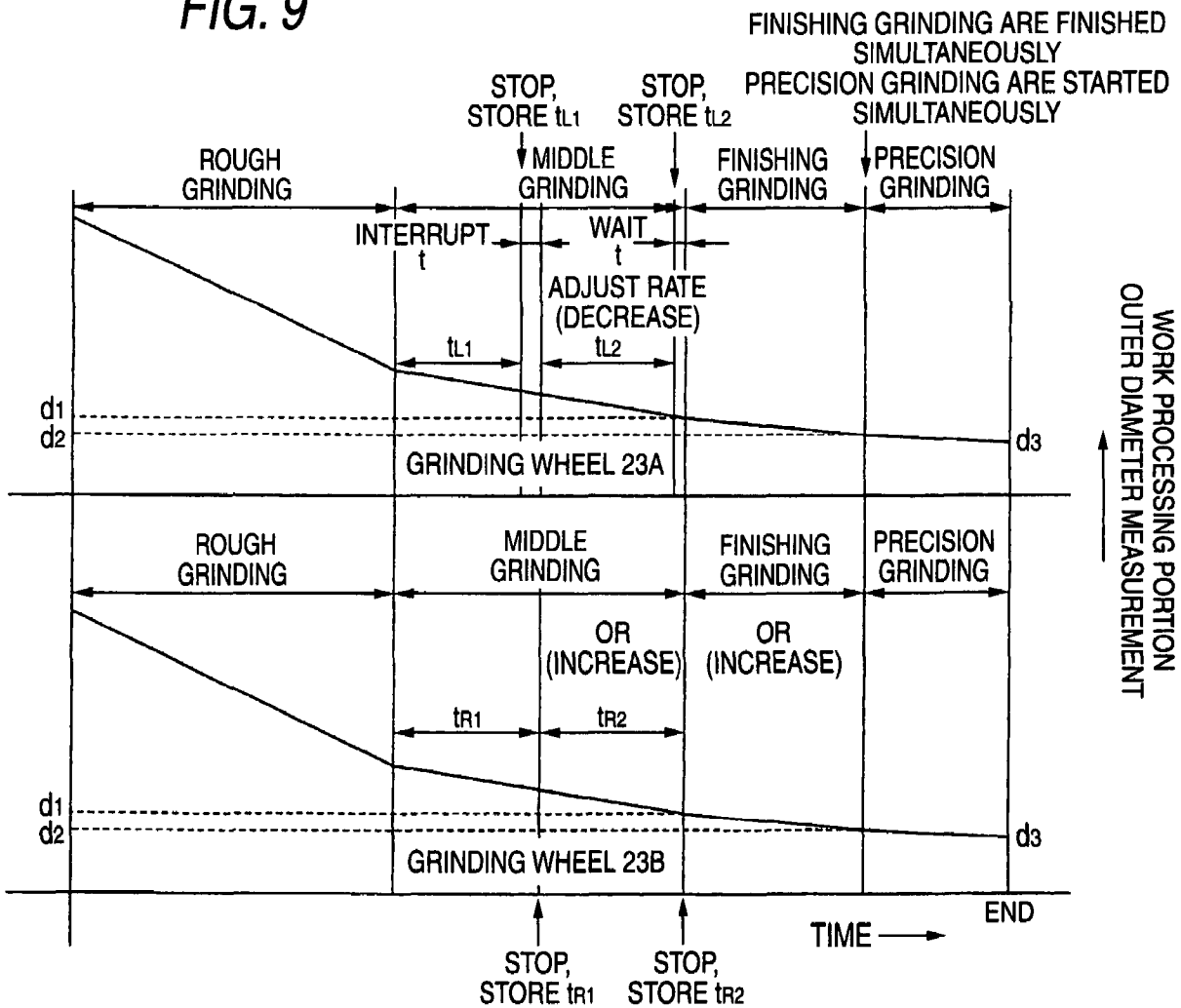
FIG. 9 is a diagram explaining the grinding processing operation of the double-headed grinding machine showing a different embodiment from that shown in the diagram shown in FIG. 8.

In addition, as shown in FIG. 9, for example, dividing the middle rough grinding step into two steps, namely, the former and latter steps and setting predetermined values d0 and d1 of the respective outer diameter measurements when the respective steps are finished, respectively, twice adjustments may be performed in FIG. 9 by adding once in mid-course of the middle rough grinding step. Every time the step proceeds, the adjustment amount of the time difference t ($=t_R1-t_L1$, $t_R2-t_L2$) is gradually eliminated, and till the finishing grinding step, the difference of the rates of the both grinding wheels 23A and 23B is almost eliminated. Thereby, it is possible to more stably finish the finishing grinding step at the same time and the processing precision can be improved. Not only the middle rough grinding step but also the finishing grinding step may be divided.

Second Embodiment

Figure 11:
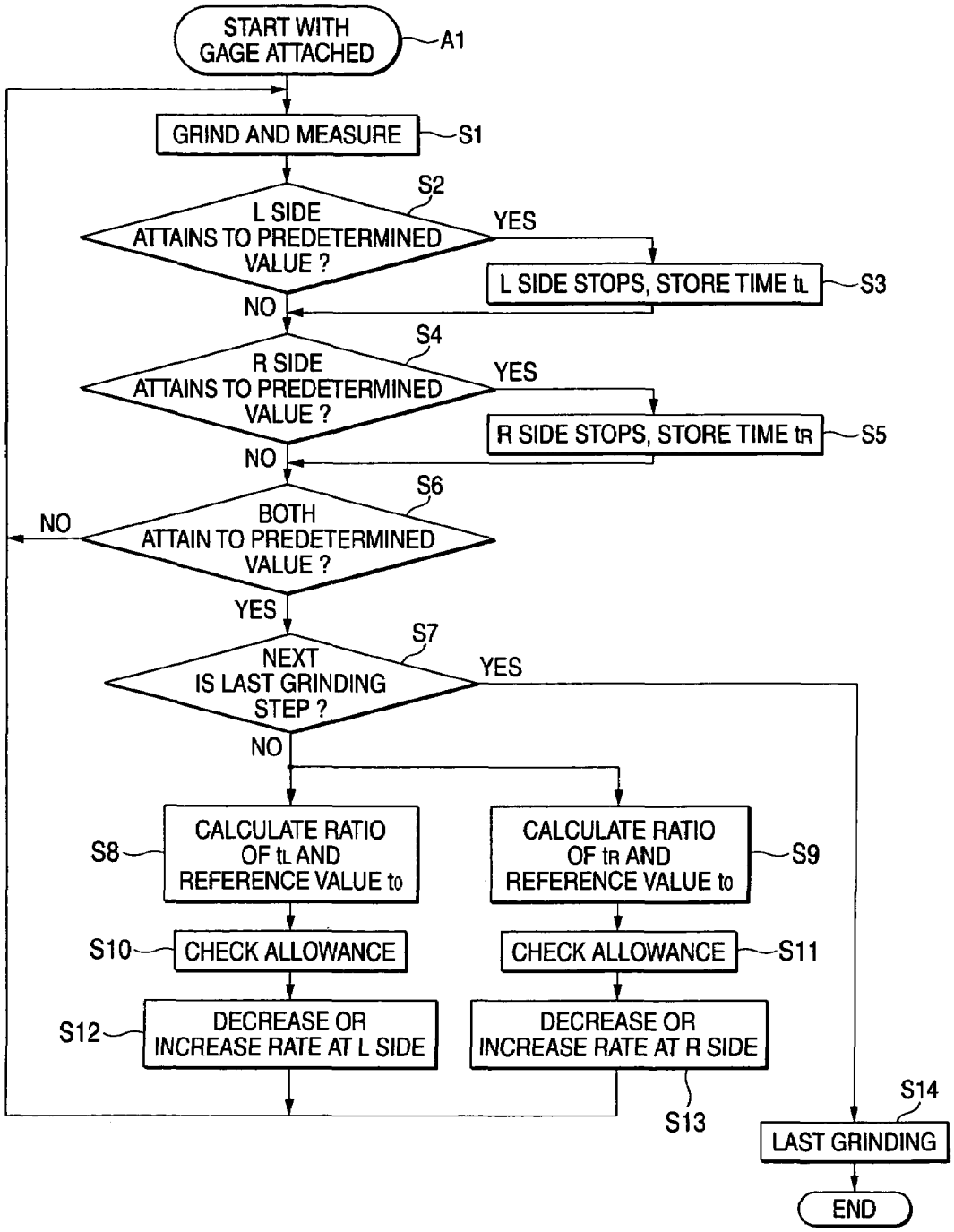
FIG. 11 is a flowchart explaining the grinding processing operation of a second embodiment.
Figure 12:
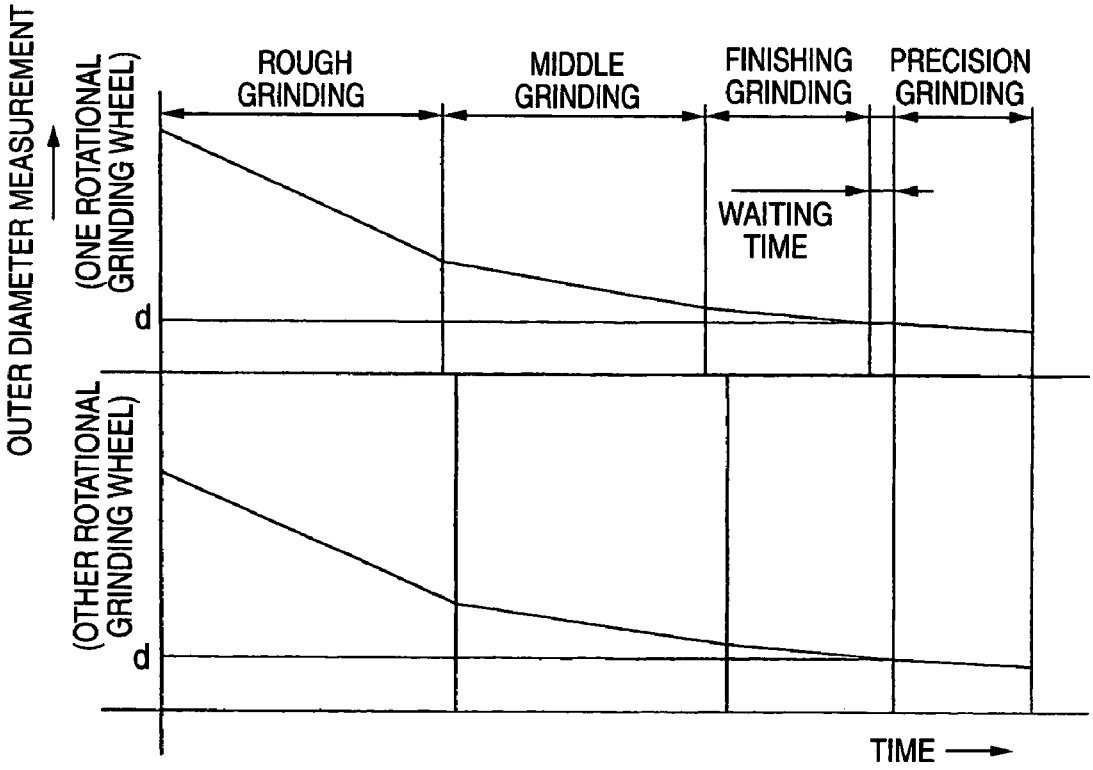
FIG. 12 is a diagram explaining the grinding processing operation of a conventional art.

Next, the second embodiment of the present invention will be described below with reference to FIG. 11. The first embodiment is configured in such a manner that, in the case that the processing time difference t represented by the measurement difference s between the processing portions Wb (Wa) and Wc (Wd) is generated, the feeding amount per unit time in the grinding wheels 23A and 23B is increased or decreased, namely, the feeding rate is increased or decreased so as to eliminate that processing time difference t, on the basis of the mode set by the input device 52. On the contrary, the second embodiment is configured as follows. In other words, the processing for setting the elimination mode according to the first embodiment (S1 in FIG. 4) does not exist and the flow chart may start from S2 of FIG. 4. Accordingly, the processing of S1 to S7 and S14 in FIG. 11 are the same as those of S2 to S8 in FIG. 4.

In S8 and S9 according to this second embodiment, with respect to each of the processing times $t_L$ and $t_R$ in S3 and S5, a ratio for the reference value $t_0$ that has been set in advance as the schedule value may be calculated. In S10 and S11, after determining the allowable range as S10 and S15 in FIG. 4 and carrying out the allowance check of replacement processing, in S12 and S13, the feeding rate of the grinding wheel of which grinding is late is increased and the feeding rate of the grinding wheel of which grinding is fast is decreased so as to eliminate the difference by comparison with the reference value $t_0$ in S12 and S13. By adjusting the both grinding wheels in this way, the adjustment amount is made smaller, a preferable grinding processing condition can be maintained, and further, the processing efficiency can be improved since the total waiting time can be made shorter than the conventional case. Then, since the grinding processing close to the original schedule is carried out, the schedule can be easily managed.

OTHER EMBODIMENT

In the meantime, the present invention may be embodied as follows:

Namely, the present invention can be embodied in the many-headed grinding machine having three and more grinding wheel; and the present invention is used so as to grind and process the element other than the clunk shaft as the work W, for example, a shaft.

What is claimed is:

1. An apparatus having a plurality of heads for simultaneously grinding processing a plurality of places of a workpiece supported by a work supporting section, wherein each head has a grinding wheel and is independently controlled, the apparatus comprising:

a measuring section which measures an outer diameter of each grinding place in a mid-course of grinding; and an adjusting section which eliminates a difference between the outer diameter measurements of the grinding places through adjustment of a feeding amount per unit time of at least one grinding wheel.

2. The apparatus according to claim 1, wherein the adjusting section adjusts the feeding amount per unit time of at least one grinding wheel using a difference between processing times required for the outer diameter measurements of the plurality of processing places to attain a predetermined value.

3. The apparatus according to claim 2, further comprising:

a storage section for storing the processing time required for each of the plurality of grinding places to attain a predetermined outer diameter measurement value in a grinding step, wherein the adjusting section adjusts the feeding amount so that a difference between the processing times stored in the storage section is eliminated in a subsequent grinding step.

4. The apparatus according to claim 1, wherein the work supporting section rotates the workpiece by chucking opposite ends of a longitudinal workpiece.

5. A grinding method using a grinding machine having a plurality of heads for simultaneously grinding processing a plurality of places of a workpiece wherein each head has a grinding wheel and is independently controlled, the method comprising:

measuring an outer diameter of each grinding place in a mid-course of grinding; and adjusting a cutting amount per unit time of at least one grinding wheel to eliminate a difference between the outer diameter measurements of the grinding places.

6. The method according to claim 5, wherein the grinding processing includes a plurality of grinding steps from rough grinding to precision grinding, and a difference between the outer diameters of the plurality of processing places generated in a grinding step is eliminated in a subsequent grinding step prior to the precision grinding step.

7. The method according to claim 5, wherein the cutting amount per unit time of at least one grinding wheel is adjusted based on a difference between processing times required for each of the plurality of grinding places to attain a predetermined outer diameter measurement value.

8. The method according to claim 7, further comprising:

storing the processing time required for each of the plurality of girding places to attain a predetermined outer diameter measurement value in a grinding step; and adjusting the feeding amount so that a difference between the processing times stored in the storage section is eliminated in a subsequent grinding step.

9. The method according to claim 5, wherein the workpiece is a crank shaft, and the grinding wheels grind crank pins of the crank shaft.

* * * * *